United States Patent [19]

Nelson et al.

[11] Patent Number: 4,869,782

[45] Date of Patent: Sep. 26, 1989

[54] METHOD OF PRODUCING HIGH BULKING ANFRACTUOUS CELLULOSIC FIBER USING ANHYDROUS LIQUID AMMONIA

[75] Inventors: John G. Nelson, Waupaca, Wis.; Richard E. Kajander, Ware, Mass.; John G. Nelson, Waupaca, Wis.

[73] Assignee: James River-Norwalk, Inc., Norwalk, Conn.

[21] Appl. No.: 155,360

[22] Filed: Feb. 12, 1988

[51] Int. Cl.[4] ..... D21C 9/00

[52] U.S. Cl. ..... 162/9; 162/24; 162/70; 162/71

[58] Field of Search ..... 162/63, 9, 70, 71, 101, 162/24

[56] References Cited

U.S. PATENT DOCUMENTS 3,707,436 12/1972 O'Connor ..... 162/69

4,227,964 10/1980 Kerr et al. ..... 162/9

4,488,932 12/1984 Eber ..... 162/101

OTHER PUBLICATIONS

*Perry's Chemical Engineers' Handbook,* Perry et al., pp. 3–5 and 3–43; McGraw-Hill, N.Y. 1963.

*Primary Examiner*—Steve Alvo

*Attorney, Agent, or Firm*—William A. Aguele; Thomas H. Whaley; Richard J. Gallagher

[57] ABSTRACT

Anfractuous cellulose fibers exhibiting exceptional high bulking properties are produced by treatment of dry hammermilled wood cellulose fibers with anhydrous liquid ammonia at substantially atmospheric pressure. Fibrous webs of enhanced bulk are produced by preparing an aqueous furnish comprising at least ten percent by weight ammonia treated anfractuous fibers in admixture with conventional papermaking fibers.

3 Claims, No Drawings

METHOD OF PRODUCING HIGH BULKING ANFRACTUOUS CELLULOSIC FIBER USING ANHYDROUS LIQUID AMMONIA

This invention relates to the manufacture of fibrous web products. In one of its more specific aspects, this invention relates to a process in which substantially dry anfractuous hydrophilic fibers are treated with liquid anhydrous ammonia. Treatment of anfractuous fibers with anhydrous ammonia imparts some permanence to the kinks, curls and other intorsions whereby the fibers are less subject to relaxation in an aqueous environment.

In a conventional wet-forming papermaking procedure, a pulp of papermaking fibers, e.g. hydrophilic cellulosic fibers obtained from wood, is subjected to a succession of treatments including refining by mechanical beating and then, as a highly dilute slurry or furnish of separated fibers, is deposited on a moving foraminous wire support to form a web from which water is progressively removed by a combination of centrifugal force, gravity, vacuum, compaction, and thermal drying forming a usable dry paper sheet. The constituent fibers of the produced web or sheet are more or less straight, ribbonlike fibers, which may be randomly disposed or directionally oriented and lying flat (though overlapping) in the planar web and being strongly bonded together by so-called hydrogen bonding.

Products of high liquid absorbency and softness, e.g., facial and sanitary tissues, toweling, and industrial wipes, require a web of higher bulk (expressed as caliper per ply) than is attained by the foregoing steps. Some increase in wet-formed web bulk can be effected by subjecting the web to a creping operation as it leaves the thermal drying stage, but still greater enhancement of bulk, and alternative methods of enhancing bulk, are nevertheless often desired. Air-laid forming procedures readily produce high-bulk webs; however, air-laid forming processes require the use of an artificial bonding agent as hydrogen bonding does not occur in an air-laid web. Improved methods of wetforming high bulk webs are therefore in great demand.

It has heretofore been recognized that a paper or like web of high bulk can be achieved by constituting the web at least partially of fibers which are anfractuous, i.e., curled, kinked, twisted- bent or otherwise contorted, and which, in consequence, produce a less dense web, the anfractuous fibers imparting thickness and softness to the web. Various treatments are known for rendering wood and/or other hydrophilic cellulosic fibers anfractuous, including wet milling, hammermilling or other dry milling treatments carried out under known conditions such that the fibers are individualized and remain substantially nonfibrillated. The fibers contorted by the aforementioned milling procedures, however, generally retain the induced contortions resulting from mechanical treatment for only a finite period of time. The induced contortions relax relatively quickly in water; hence incorporation of anfractuous fibers in a pulp which is conventionally wet-formed may not result in optimum bulk enhancement of the produced web.

Expedients proposed to overcome this problem have included techniques, such as chemical cross-linking of fibers and high-energy mechanical milling of fibers to prevent or at least retard relaxation of the contorted fibers in water. It has also been proposed to use transiently anfractuous fibers in a pulp in a wetforming procedure wherein the conditions of slurry preparation and web formation are controlled to limit the duration and extent of contact of the anfractuous fibers with water, so that the fibers remain substantially contorted in the produced and dried web. Typically, the furnish is constituted of a mixture of anfractuous fibers and conventional papermaking fibers, viz., fibers, such as hydrophilic cellulose fibers, e.g., wood fibers, which have not been subjected to mechanical or chemical treatment to render them anfractuous.

It has now been discovered that the bulking properties of hammermilled anfractuous cellulose fibers may be further enhanced by treatment of the dry hammermilled fibers with liquid anhydrous ammonia. The present invention contemplates the provision of new and improved processes for making paper or like fibrous webs of relatively high bulk by wet-forming a pulp including anfractuous fibers.

In accordance with a preferred embodiment of this invention, anfractuous fibers suitable for use in a wet-forming process for producing a fibrous web are produced by dry milling hydrophilic cellulose fibers, e.g., wood fibers, effecting mechanical deformation of the fibers; and treating the resulting dry deformed fibers with anhydrous liquid ammonia. A high bulk web may be produced by preparing an aqueous furnish having a fiber content comprising the hammermilled, liquid ammonia treated fibers; wet-forming a web from the furnish; and removing water from the web.

Preferably, treatment of the cellulosic fibers with anhydrous liquid ammonia is carried out at near atmospheric pressure. However lower or higher pressures may be employed. The antogenous temperature produced by vaporization of ammonia at the system pressure is preferred.

A pressure in the range of 0.7 to 1.3 bar for treatment of the fibers at the corresponding temperature in the range of from about −28° C. to about −40° C. (about −18° F. to about −40° F.) is generally satisfactory. The time of treatment of the fibers with ammonia may range from about 5 seconds to 30 seconds or longer. Treatment time is not critical so long as the outer fiber layers, at least, are wet with liquid ammonia.

Preferably, the anfractuous fibers are prepared by defiberizing dry laps of treatable fibers in a hammermill. The terms "dry" and "substantially dry", as used herein, mean that no free water is present in the fibers, although the laps, bales, or the like will normally contain as much as about 15 percent equilibrium moisture by weight as a result of storage under atmospheric conditions. When cellulosic treatable fibers are conditioned by dry hammermilling, it is believed that the relatively high temperatures within the hammermill, usually between 150° and 210° F., resulting from the dissipation of mechanical energy as heat, enhance the effect produced by the shearing forces alone by eliminating some hydroxyl groups associated with the cellulose, thus introducing additional constrictive and contortive forces upon the individual fibers. This partial dehydroxylation of the cellulose tends to make the fibers exposed to it less rewettable, possibly owing to closer association of the remaining hydroxyl groups, thus serving to preserve the anfractuous or "three dimensional". nature of the fibers. Leaving the hammermill, the moisture content of the fibers is about 1 to 5% by weight, and is essentially a function of the equilibrium moisture content of the particular fiber at the mill temperature.

Anfractuous fibers produced by a dry milling operation as just described and thereafter subjected to an anhydrous ammonia treatment in accordance with the present invention impart improved bulk to the product web as compared with similar fibers subjected to hammermilling only. It is found that the anhydrous ammonia treatment of the fibers significantly enhances the bulk of wet laid webs produced from the ammonia treated hammermilled fibers, as compared to webs produced by similar procedures but without the liquid anhydrous ammonia treatment. The anhydrous ammonia treatment improves the ability of the treated anfractuous fibers to retain their contortions when they are exposed to water for an extended period of time. The advantage of bulk enhancement of the product by the inclusion of anfractuous fibers is evident when the fiber furnish is made up as a conventional water slurry, but is somewhat less pronounced when the fibers are dispersed in an aqueous foam and formed into a web under conditions of minimized exposure to water.

In accordance with a specific embodiment of this invention a fibrous web is produced by a wet-forming process from a fiber furnish in water or foamed aqueous liquid wherein the fiber content of the furnish comprises at least 10 percent by weight of liquid ammonia treated cellulose fibers produced by the method described above. The furnish is deposited onto a moving foraminous support to wet-form a single-ply or multi-ply fibrous web in which at least one ply contains anfractuous fibers produced by the method of this invention.

In a preferred embodiment of a method of producing a fibrous web utilizing the treated fibers of this invention, the treated kinked fibers and untreated conventional fibers are dispersed in a foamed liquid medium comprising water, air and surfactant and the resulting foam furnish dispensed onto a moving foraminous forming means to form a wet web. U.S. Pat. No. 4,443,297 to Cheshire and U.S. Pat. No. 3,716,449 to Gatward, et al. disclose suitable methods of foam forming webs and are incorporated herein by reference. The excess liquid draining through the foraminous forming means is collected and recycled in a closed loop system. The preferred foraminous forming surface is of the twin wire type known in the art wherein two separate foraminous wires converge to form a nip, and the furnish is introduced into the nip from a suitable headbox. The wet web is then dried conventionally, the ultimate web product having a moisture content of about 5 percent water by weight. Standard processing treatments that may be performed on the web between forming and take-up on a parent roll include wet pressing, consolidation, embossing, and creping, each such operation being well known in the art of web manufacturing.

The web product comprises 10 to 100 percent by weight of the treated fibers described previously, the balance, if any, being made up of untreated conventional papermaking fibers. Preferably, the weight ratios of treated to untreated fibers is in the range about 0.33 to 3, i.e., 25 to 75 percent by weight treated fibers in admixture with untreated fibers.

The pulp may be obtained directly from existing mill operations, or may be prepared from laps, bales, or rolls of untreated fibers in a repulping operation.

The untreated fibers are dispersed in water or a foamed aqueous liquid carrier medium, suitable water. In the preferred embodiment, a portion of the liquid recovered from the forming apparatus is used to provide a fiberfoam furnish consistency of between about 1.5 to about 4 percent fibers (treated or untreated) by weight, which is subsequently diluted to form a final fiberfoam furnish headbox consistency of from about 0.3 to about 4 percent by weight. The wet web is then laid as described above. Any deficit in water and/or surfactant circulating in the closed loop system is made up as required by addition to the system from a suitable source of supply.

In accordance with this invention, the treated fibers are produced by subjecting cellulose fibers to a milling step, preferably a dry hammermilling operation, mechanically deforming the fibers and rendering them anfractuous. The dry milled fibers are then subjected to a post-milling liquid anhydrous ammonia treatment by contacting the milled fibers with liquid anhydrous ammonia at a temperature in the range of −28° to −40° C. This treatment not only preserves the fiber deformation but increases their anfractuous characteristics.

The conventional fibers used in admixture with the treated fiber are primarily cellulose (wood) fibers which may include synthetic fibers, such as polyester, polypropylene, polyethylene, polyamide, and nylon fibers, as well as chemically modified cellulosic fibers such as rayon, cellulose acetate, and other cellulose ester fibers. These synthetic and modified natural fibers are now used commonly in the manufacture of fibrous webs, either alone or in combination with natural cellulosic fibers when specific attributes of the web are desired. For example, a blend of synthetic and natural cellulosic fibers is advantageous to obtain a multi-use, ultimately disposable, industrial wipe. The synthetic fibers provide strength while the conventional cellulose fibers provide absorbency, and in combination with the treated conventional fibers, enhanced absorbency and bulk.

The class of treatable fibers includes all of the natural cellulose fibers referred to above as well as chemically modified cellulosic ester fibers, which fibers are generally considered hydrophilic when the degree of substitution of hydroxyl groups present therein is less than about 1.0.

EXAMPLES 1 to 3

Dry hammermilled Ontario softwood (OSW) fibers were treated at atmospheric pressure by immersion in liquid ammonia in an open insulated vessel for a period of about 5 to 10 seconds after which ammonia adsorbed on the treated fibers was allowed to evaporate in air at ambient temperature. Handsheets having a basis weight of 60 g/m$^2$ (36.9 pounds per 3000 ft$^2$ ream) were prepared by standard TAPPI Method T205 OM-81 from OSW lap pulp, OSW hammermilled pulp and the ammonia treated fibers produced by the method of this invention.

Dispersions of fibers from batches of each fiber type, untreated, hammermilled, and liquid ammonia treated dry hammermilled fibers, were made up in water by mixing for 60 seconds in a Waring Blender to form a water furnish and formed into handsheets. Separate dispersions from the same fiber batches were made up with water containing a surfactant to form a fiber-foam furnish from each fiber type and made into handsheets.

Comparative results indicating the bulking characteristics of each of the fiber types, as indicated by the two-ply caliper of uncompacted handsheets (TAPPI Method T411 OM-84) are shown in Table I.

TABLE I

| Example | Pulp Treatment | Caliper-2 Ply, Mils | |
|---|---|---|---|
| | | Water | Foam |
| 1 | Lap Pulp | 14.8 | 17.7 |
| 2 | Hammermilled Pulp | 21.9 | 33.2 |
| 3 | $NH_3$ Treated Hammermilled Pulp | 54.1 | 50.1 |

The superior bulking characteristics of the liquid ammonia treated hammermilled fibers are illustrated in the above table by comparison of the calipers of the handsheets of Example 3 with those of Examples 1 and 2. As indicated therein, the handsheets prepared from a water slurry of liquid ammonia treated hammermilled fibers (Example 3) showed an increase in caliper to about two and one half times the caliper of sheets produced from hammermilled fibers along (Example 2). Liquid ammonia treatment resulted in a caliper increase of about one and one half times that of hammermilled fibers when test sheets were produced from fiber-foam slurry.

That the liquid ammonia treated hammermilled fibers are relatively stable and less susceptable to loss of their anfractuous properties is illustrated by comparison of Example 3 with Example 2. The calipers of the webs formed from a water furnish and from a fiber-formed furnish in Example 3 are essentially equal (54.1 vs. 50.1) whereas hammermill fibers exhibit approximately a 50 percent increase in the caliper when produced from a fiber-foam dispersion than when produced from a water dispersion.

We claim:

1. A method for the production of high bulking anfractuous cellulosic fibers which comprises (a) dry milling hydrophilic cellulosic fibers containing no free water thereby mechanically deforming said hydrophilic fibers rendering them anfractuous;

(b) wetting dry mechanically deformed cellulose fibers containing no free water from step (a) with substantially anhydrous liquid ammonia for a period of time in the range of from about five seconds to about thirty seconds, and (c) recovering resulting ammonia-treated anfractuous fibers as product.

2. A method according to claim 1 wherein ammonia fibers are removed by vaporization of ammonia therefrom.

3. A method according to claim 1 wherein the treatment with anhydrous liquid ammonia is carried out at a temperature in the range of 31 18° F. to −40° F. at the corresponding vapor pressure of said ammonia.

* * * * *

UNITED STATES PATENT AND TRADEMARK OFFICE

CERTIFICATE OF CORRECTION

PATENT NO. : 4,869,782

DATED : September 26, 1989

INVENTOR(S) : John G. Nelson and Richard E. Kajander

It is certified that error appears in the above-identified patent and that said Letters Patent is hereby corrected as shown below:

Column 5, line 18, "along" should read --alone--.

Column 5, line 27, "fiber-formed" should read --fiber-foamed--.

Column 6, Claim 3, line 25, delete "31" and insert a minus sign (-) before "18°F".

Signed and Sealed this

Sixth Day of August, 1991

*Attest:*

*Attesting Officer*

HARRY F. MANBECK, JR.

*Commissioner of Patents and Trademarks*